US009130278B2

(12) United States Patent
Palevsky et al.

(10) Patent No.: US 9,130,278 B2
(45) Date of Patent: Sep. 8, 2015

(54) DUAL LINEAR AND CIRCULARLY POLARIZED PATCH RADIATOR

(71) Applicant: Raytheon Company, Waltham, MA (US)

(72) Inventors: Alan Palevsky, Wayland, MA (US); John J. Magnani, Framingham, MA (US)

(73) Assignee: Raytheon Company, Waltham, MA (US)

( * ) Notice: Subject to any disclaimer, the term of this patent is extended or adjusted under 35 U.S.C. 154(b) by 332 days.

(21) Appl. No.: 13/684,932

(22) Filed: Nov. 26, 2012

(65) Prior Publication Data

US 2014/0145891 A1 May 29, 2014

(51) Int. Cl.
*H01Q 13/10* (2006.01)
*H01Q 9/04* (2006.01)

(52) U.S. Cl.
CPC ..... *H01Q 13/103* (2013.01); *H01Q 9/0435* (2013.01); *H01Q 9/0457* (2013.01); *H01Q 13/106* (2013.01)

(58) Field of Classification Search
USPC ..... 343/700 MS, 850, 893, 770, 746
See application file for complete search history.

(56) References Cited

U.S. PATENT DOCUMENTS

| | | | | |
|---|---|---|---|---|
| 3,665,480 | A | | 5/1972 | Fassett |
| 4,527,165 | A | | 7/1985 | de Ronde |
| 4,751,513 | A | | 6/1988 | Daryoush et al. |
| 4,792,810 | A | * | 12/1988 | Fukuzawa et al. ..... 343/778 |
| 5,005,019 | A | | 4/1991 | Zaghloul et al. |
| 5,055,852 | A | | 10/1991 | Dusseux et al. |
| 5,241,321 | A | * | 8/1993 | Tsao ..... 343/700 MS |
| 5,400,040 | A | | 3/1995 | Lane et al. |
| 5,451,969 | A | | 9/1995 | Toth et al. |
| 5,563,613 | A | | 10/1996 | Schroeder et al. |
| 5,675,345 | A | | 10/1997 | Pozgay et al. |
| 5,724,048 | A | | 3/1998 | Remondiere |
| 5,786,792 | A | | 7/1998 | Bellus et al. |
| 6,061,027 | A | | 5/2000 | Legay et al. |
| 6,087,988 | A | | 7/2000 | Pozgay |
| 6,104,343 | A | | 8/2000 | Brookner et al. |
| 6,127,985 | A | | 10/2000 | Guler |
| 6,181,280 | B1 | | 1/2001 | Kadambi et al. |
| 6,184,832 | B1 | | 2/2001 | Geyh et al. |

(Continued)

FOREIGN PATENT DOCUMENTS

| | | |
|---|---|---|
| CA | 2218269 | 4/1999 |
| EP | 0 481 417 A1 | 4/1992 |

(Continued)

OTHER PUBLICATIONS

Search Report of the ISA for PCT/US2013/067648 dated Jan. 8, 2014.

(Continued)

*Primary Examiner* — Dieu H Duong
(74) *Attorney, Agent, or Firm* — Daly, Crowley, Mofford & Durkee, LLP

(57) ABSTRACT

A patch radiator suitable for operation with circular or dual linear polarizations is described. The patch radiator includes a patch antenna element and a pair of excitation circuits. The excitation circuits include a feed line and a turning circuit configured such that a single feed line enables independent operation of each polarization. This allows for the operation of the patch and therefore array as either linear, slant, elliptical, or circular polarization.

14 Claims, 7 Drawing Sheets

(56) References Cited

U.S. PATENT DOCUMENTS

| | | | | |
|---|---|---|---|---|
| 6,208,316 | B1 | 3/2001 | Cahill | |
| 6,211,824 | B1 | 4/2001 | Holden et al. | |
| 6,222,493 | B1 | 4/2001 | Caille et al. | |
| 6,624,787 | B2 | 9/2003 | Puzella et al. | |
| 2003/0214437 | A1 * | 11/2003 | Rawnick et al. ..... | 343/700 MS |
| 2008/0030422 | A1 | 2/2008 | Gevargiz et al. | |

FOREIGN PATENT DOCUMENTS

| | | | |
|---|---|---|---|
| EP | 0 481 417 | B1 | 4/1992 |
| WO | WO 98/26642 | | 6/1998 |
| WO | WO 99/66594 | | 12/1999 |
| WO | WO 01/41257 | A1 | 6/2001 |
| WO | 03/007423 | A1 | 1/2003 |
| WO | 03/030301 | A1 | 4/2003 |

OTHER PUBLICATIONS

Written Opinion of the ISA for PCT/US2013/067648 dated Jan. 8, 2014.

* cited by examiner

DUAL LINEAR AND CIRCULARLY POLARIZED PATCH RADIATOR

FIELD

The concepts, systems, circuits, devices and techniques described herein relate generally to radio frequency (RF) circuits and more particularly to RF antennas.

BACKGROUND

As is known in the art, a so-called patch antenna element (also referred to as "a patch element" or more simply "a patch") is a basic building block a number of different types of phased array antenna including so-called panel phased arrays (or panel arrays) such as the types described in U.S. Pat. Nos. 7,348,932; 7,671,696; and 8,279,131, all of which are assigned to the assignee of the present application. The patch element is integrated within a panel array to allow for the use of low cost printed wiring board (PWB) processes in the manufacture of the panel array.

Referring now to FIG. 1, a conventional patch element 2 and feed circuit 3 are coupled to provide a conventional patch radiator 4. The patch element is provided from a conductor disposed on a first surface of a substrate. A slot 5 is etched or otherwise provided in the conductor. The feed circuit 4 is provided from a single feed line 7 disposed on a second opposite surface of the substrate. A first end of the feed line corresponds to an antenna feed port 4A and a second end of the feed line 4B is coupled to a ground plane through a conductive via. An open ended stub 8 is coupled to feed line 7 as is generally known. Patch radiator 4 is responsive to radio frequency (RF) signals having a single linear polarization.

In operation, an RF signal provided to the antenna feed port 4A is coupled via feed line 7 to the open ended stub 8 thereby illuminating slot 5, which in turn excites the patch 2. Similarly, signals provided to patch conductor 2 illuminate the slot 5 and are coupled via the open ended stub 8 and feed line 7 to the feed line antenna feed port 4A. Thus, the patch radiator 4 operates for both transmitting and receiving RF signals.

As mentioned above, however, patch radiator 4 can be used only for a single polarization. This is due to the topology of the patch element 2 and feed circuit 3. To support dual and/or circular polarization, a more complicated geometry is required as illustrated in FIG. 2.

Referring now to FIG. 2, to support dual and/or circular polarization in one type of conventional patch radiator, a feed circuit comprising four feed lines (and thus four antenna feed ports) is required. Essentially, the single stub described above in conjunction with FIG. 1 is split into two open ended stubs (e.g. one to excite vertically polarized RF signals and one to excite horizontally polarized RF signals). To support dual linear polarization, both stubs (for each excitation) are driven in phase. This is conventionally accomplished via a microwave power divider circuit (not shown in FIG. 2). Simple geometry dictates the need four feeds. The single polarization example (FIG. 1) places the open ended stub along the center line. However, it is not possible to place two perpendicular open ended stubs, each aligned to the center line without them being shorted to each other. Therefore two open ended stubs are required for each polarization Circular polarization may be obtained by introducing a ninety (90) degree phase shift between signals provided to (or received from) the horizontal and vertical stubs. Such a 90 degree phase shift can be accomplished using a ninety (90) degree hybrid coupler (not shown in FIG. 2) or by controlling the phases independently in control circuitry (not shown in FIG. 2). Therefore, to extend the operation of a patch radiator from a single linear polarization to operation with dual linear or circular polarization requires the addition of much circuitry (e.g. a power divider or hybrid coupler) to the feed circuit.

In a phased array antenna in which space in limited, it is difficult to fit such additional circuitry (e.g. additional power divider or hybrid coupler circuitry) within a so-called unit cell which includes an antenna element (e.g. one or more patch elements) and the associated feed circuitry. It would, therefore, be desirable to provide a patch radiator operable for use with dual linear or circular polarization RF signals and which is compact enough for use in phased array antennas.

SUMMARY

In accordance with the concepts, systems and circuits described herein, a patch radiator suitable for operation with dual linear or circularly polarized radio frequency (RF) signals includes a patch antenna element and a feed circuit. The feed circuit includes a feed line terminating in a stub region having an open circuit impedance characteristic and a tuning stub disposed a selected distance from the open circuit stub region of the feed line with the tuning stub selected to provide an impedance characteristic which establishes resonance with the feed line at a desired frequency.

With this particular arrangement, a patch radiator capable of dual linear or circular polarization operation and suitable for use in a unit cell of a phased array antenna is provided. By utilizing a tuning stub to establish resonance with a single feed line, a single antenna feed port can be used for operation of the patch radiator at dual linear or circular polarizations without the use of external circuitry such as power divider circuits, hybrid circuits or any other type of power splitting circuitry (all such circuitry collectively referred to herein as "power splitter circuits"). The tuning stub establishes an appropriate impedance to set up a standing wave between two open ended stubs coupled to the patch antenna element. This requires tuning the open to set up the resonance between the feed and the tuned stubs. To a zeroth order approximation, the length of the opens should be ¼ A wavelength to get the desired resonance. However, due to the complex coupling of the design, the correct length is obtained through iterative numerical simulations.

Although the above-described single feed line-tuning stub approach works over a limited bandwidth (e.g. a 10% bandwidth), since the patch antenna element itself only works well over a limited bandwidth, this is not a major limitation to operation of a patch radiator. Moreover, by eliminating the need for power splitter circuits to achieve dual linear or circular polarization, the radiation efficiency of this approach is higher than that of conventional approaches as the losses from such power splitter circuits are eliminated.

Furthermore, the tuning stub enables the patch radiator to operate with dual linear or circular polarization while using only two feed lines whereas prior art techniques require four feed lines. By eliminating two feed line and two power splitter circuits, the patch radiator as described herein (i.e. the combination of the antenna element and associated antenna element feed circuit) is made more compact compared with conventional patch radiators.

The compact patch antenna element described herein is thus able to fit within an area defined by a unit cell of a phased array antenna. In one embodiment, the compact patch radiator is able to fit an RF circuit card assembly (RF-CCA) of a phased array operating at frequencies higher than X-Band. The dual polarization phased array patch radiator has a footprint which is smaller than conventional dual polarization patch radiators because it eliminates the need for power splitters. The relatively small footprint allows for RF-CCA operation at higher frequency (e.g. Ku-Band) as the unit cell area scales inversely as the square of the frequency. Furthermore, the dual polarization phased array patch radiator is compatible with existing RF-CCA fabrication processes and scales with frequency.

The patch element includes a single feed per polarization and is capable of operation in two polarizations. When the patch element operates in one polarization, the opposite feed is terminated. With the two linear polarization feed circuits, circular polarization is created by correct phasing of the two linear inputs. The 90 degree phasing can be obtained by either an analog circuit or through digital control. The analog implementation required including on other layers of the PWB a 90 degree hybrid circuit. The digital implementation requires that the attenuator/phase shifter control chip have dual outputs that have differential phase control. For circular polarization the difference would be either +/−90 degrees. This functionality would be required for both transmit and receive.

In accordance with the concepts, systems and circuits described herein, an antenna comprises a patch element having a pair of excitation circuits with one side of each excitation pair grounded at an appropriately tuned position and the other side used to transmit or receive signals from the patch element. An actual design will require iterative numerical simulations to determine the correct length for a specific frequency and PWB design.

With this particular arrangement, a patch radiator suitable for operation with dual linear or circular polarization while eliminating need for a two sided feed for each excitation is provided. One side of each excitation pair is grounded at an appropriate position and the other side is used as to transmit or receive from the patch element. This eliminates the need for power divider circuitry needed in conventional dual polarization patch radiators. The presence of a grounded stubs in the excitation circuits acts as a tuned "reflector" and keeps the polarization purely linear and efficiently couples the electric fields between the stub, slot and patch. Without the grounded stub, the off center excitation creates a radiation pattern that is not linear. Without two orthogonal linear excitations, it is not possible to generate circular polarization with low axial ratio.

The efficiency of a conventional dual stub approach is degraded by the cross talk between the two stubs. In transmit mode, the microwave radiation launched from one stub is absorbed at the other and then travels back to the source. This is energy that is not launched through the patch. Typical efficiencies of such conventional designs at 10 GHz are about 60%.

The shorted stub approach described herein, on the other hand, results in efficiencies which can be as high as 80%.

In accordance with a still further aspect of the concepts, systems and circuits described herein, a circularly polarized patch radiator includes a patch antenna element and a pair of excitation circuits with one side of each excitation pair grounded at an appropriate position and the other side used to transmit or receive from the patch antenna element.

In one embodiment, the patch antenna element is provided from an antenna conductor disposed on a substrate with first and second slots disposed in a first direction in the antenna conductor and third and fourth slots disposed in a second, orthogonal direction in the antenna conductor.

In one embodiment, each excitation circuit includes a feed line terminated in an open circuit impedance and a tuning circuit disposed a selected distance from the feed line with the tuning circuit selected to provide an impedance characteristic which establishes resonance with the feed line at a desired frequency.

In one embodiment, the feed lines of the respective excitation circuits are coupled to adjacent sides of the antenna conductor.

In one embodiment, the tuning circuit is provided as a tuning stub having a shape selected to provide an impedance characteristic which establishes resonance with the feed line at a desired frequency.

In accordance with a still further aspect of the concepts, systems and circuits described herein, a phased array antenna includes a plurality of patch radiators, each of the patch radiators including a patch antenna element and a pair of excitation circuits with one side of each excitation pair being grounded at an appropriate position and the other side used to transmit and/or receive from the patch antenna element which enables the patch radiators to be responsive to RF signals having circular polarization.

In one embodiment, the excitation circuits comprise a feed circuit which includes a feed line terminating in a stub region having an open circuit impedance characteristic and a tuning circuit disposed to provide an impedance characteristic which establishes resonance with the feed line at a desired frequency.

In one embodiment, the tuning circuit is provided as a tuning stub having a shape selected to provide an impedance characteristic which establishes resonance with said feed line at a desired frequency.

In accordance with a still further aspect of the concepts, systems and circuits described herein, a patch radiator suitable for operation with circular or dual linear polarizations includes a patch antenna element and a pair of excitation circuits. The excitation circuits include a feed line and a turning circuit configured such that a single feed line enables independent operation of each polarization. This allows for the operation of the patch and therefore array as either linear, slant, elliptical, or circular polarization.

It should be appreciated that this Summary is provided to introduce a selection of concepts in a simplified form that are further described below in the Detailed Description.

BRIEF DESCRIPTION OF THE DRAWINGS

The foregoing and other objects, features and advantages of the concepts, systems, circuits and techniques described herein will be apparent from the following description of particular exemplary embodiments as illustrated in the accompanying drawings in which like reference characters refer to like elements throughout the different views. The drawings are not necessarily to scale, emphasis instead being placed upon illustrating the concepts, systems, circuits and techniques.

DETAILED DESCRIPTION

Figure 1:
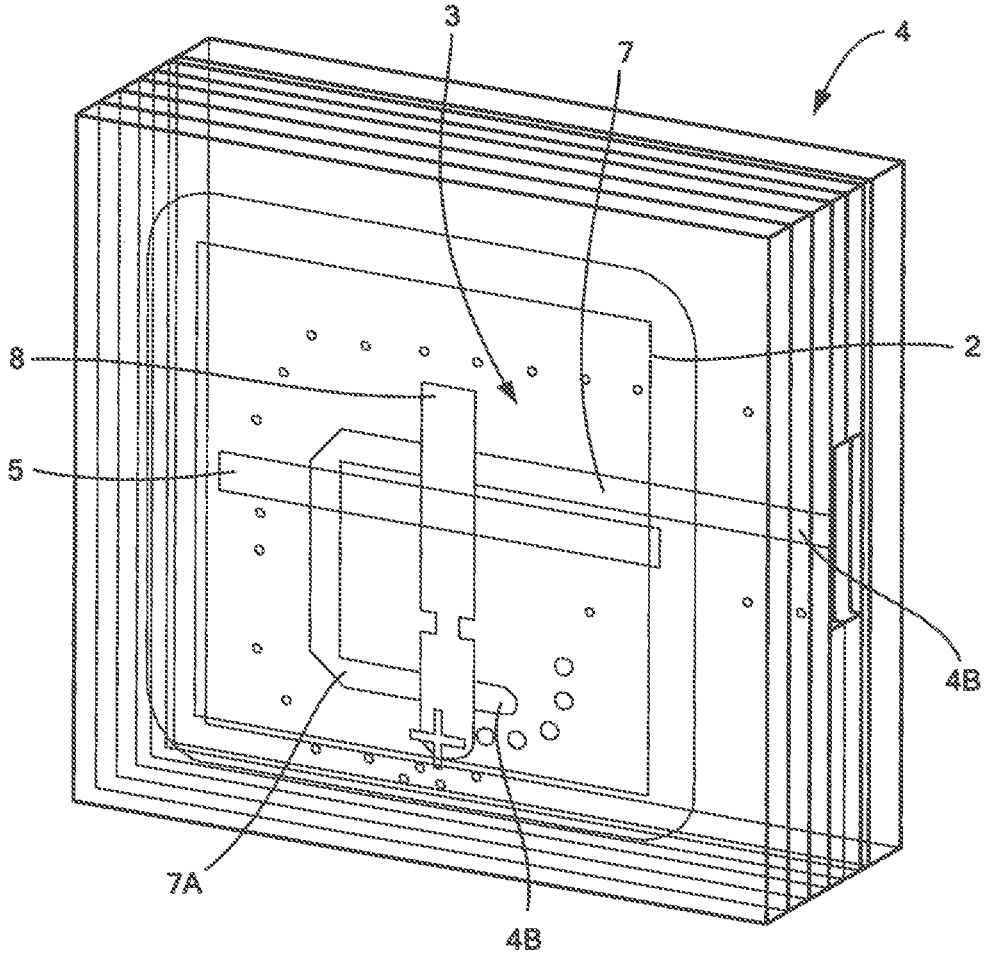
FIG. 1 PRIOR ART
FIG. 1 is an isometric view of a conventional patch radiator having a patch element and a single feed line and suitable for transmitting or receiving radio frequency (RF) signals having a single linear polarization.
Figure 2:
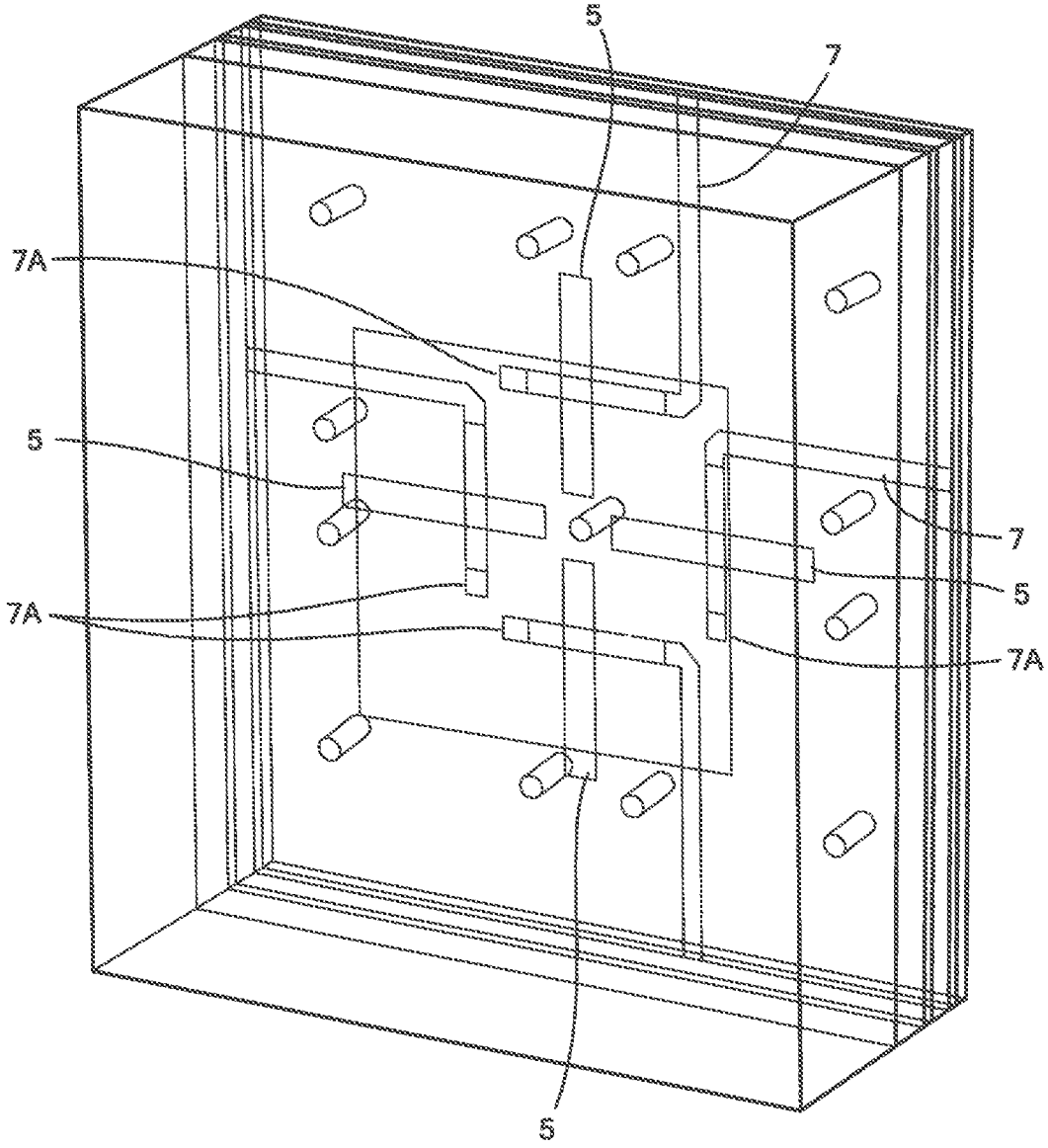
FIG. 2 PRIOR ART
FIG. 2 is an isometric view of a conventional patch radiator having a patch element and four feed lines and suitable for transmitting or receiving RF signals having dual or circular polarization.

Before describing an exemplary embodiment of a patch radiator responsive to dual linear or circular polarization, it should be appreciated that using the concepts described herein one can eliminate the two sided feed for each excitation which is conventionally needed for antenna operation with dual linear or circular polarization as shown in the exemplary embodiment of FIG. 2. Thus, the patch radiator described herein below utilizes an excitation circuit having only a single feed for each polarization. As will become apparent from the description herein below, one side of each excitation pair is grounded at an appropriate position and the other side is used as to transmit or receive from a patch.

This technique eliminates the need for power splitter circuitry conventionally required for antenna operation with dual linear or circular polarization. The presence of the grounded stub acts as a tuned "reflector" and keeps the polarization purely linear and efficiently couples the electric fields between the stub, slot and patch. Without the grounded stub, the off center excitation creates a radiation pattern that is not linear and without two orthogonal linear excitations, it is not possible to generate circular polarization having a low axial ratio.

Figure 3:
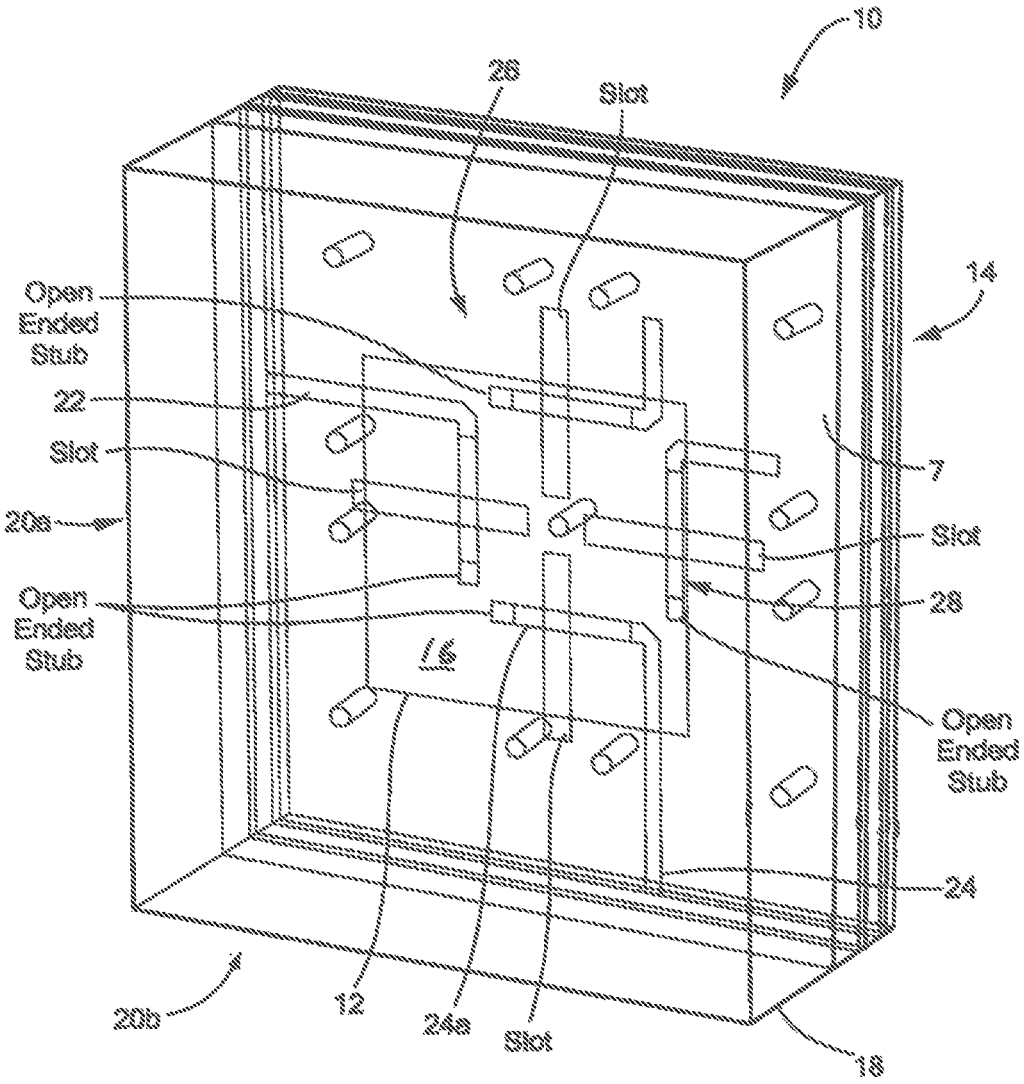
FIG. 3 is an isometric view of a patch radiator suitable for transmitting and/or receiving RF signals having dual or circular polarization.
Figure 3A:
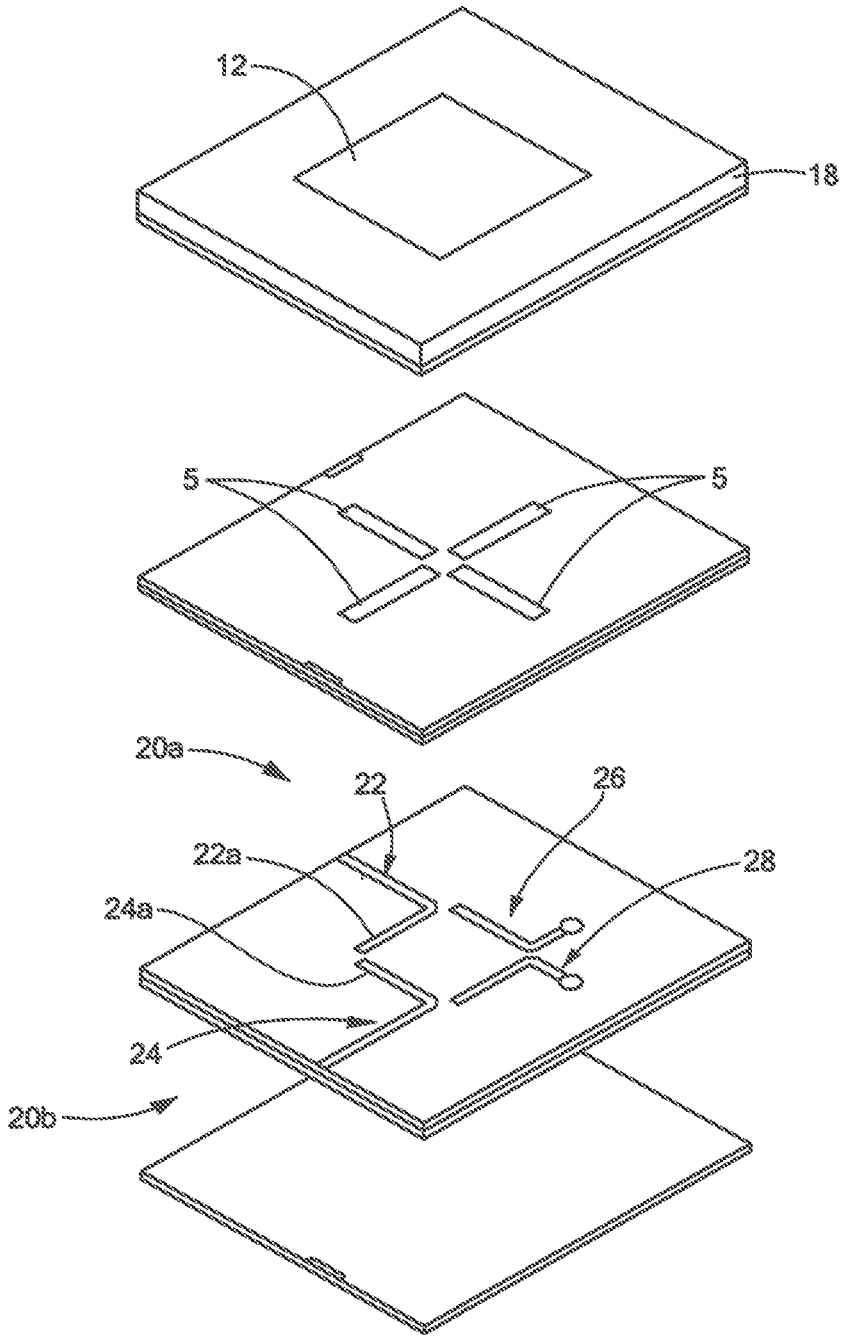
FIG. 3A is an exploded isometric view of a patch radiator suitable for transmitting and/or receiving RF signals having dual or circular polarization

Referring now to FIGS. 3 and 3A in which like elements are provided having like reference designations, a patch radiator 10 includes a patch element 12 and a feed circuit 14. Patch element 12 is provided from a conductor 16 disposed over a first surface of a substrate 18.

A pair of excitation circuits 20*a*, 20*b* are comprised of respective feed lines 22, 24 each of which include respective ones of stub regions 22*a*, 24*a* having open circuit impedance characteristics. Excitation circuits 20*a*, 20*b* also include respective ones of tuning circuits 26, 28. Tuning circuits 26, 28 are disposed to provide an impedance characteristic which establishes resonance with respective feed lines 22, 24 at a desired frequency.

In the exemplary embodiment of FIGS. 3, 3A tuning circuits 26, 28 are implemented as tuning stubs having a first end terminated in an open circuit impedance characteristic and having a second end terminated in a short circuit impedance characteristic. In one embodiment, the turning stubs are implemented as L-shaped conductors disposed on a second opposite surface of the substrate in which the patch element conductor s are disposed.

Thus, as is apparent from FIGS. 3, 3A, one side of each excitation pair is terminated at a position which results in an impedance characteristic which establishes resonance with a respective feed line a desired frequency. The presence of the stub acts as a tuned reflector and keeps the polarization purely linear and efficiently couples the electric fields between the stub, slot and patch element conductor.

Before describing the patch radiator described above in conjunction with FIGS. 3 and 3A as included in a panel array antenna, some introductory concepts and terminology are explained. A "panel array" (or more simply "panel) refers to a multilayer printed wiring board (PWB) which includes an array of antenna elements (or more simply "radiating elements" or "radiators"). A panel array often also includes RF, logic and DC distribution circuits in one highly integrated PWB. A panel is also sometimes referred to herein as a tile array (or more simply, a "tile").

An array antenna may be provided from a single panel (or tile) or from a plurality of panels. In the case where an array antenna is provided from a plurality of panels, a single one of the plurality of panels is sometimes referred to herein as a "panel sub-array" (or a "tile sub-array").

Reference is sometimes made herein to a panel array antenna having a particular number of panels. It should of course, be appreciated that an array antenna may be comprised of any number of panels and that one of ordinary skill in the art will appreciate how to select the particular number of panels to use in any particular application.

It should also be noted that reference is sometimes made herein to a panel or an array antenna having a particular array shape and/or physical size and lattice spacing or a particular number of antenna elements. One of ordinary skill in the art will appreciate that the techniques described herein are applicable to various sizes, lattice spacing and shapes of panels and/or array antennas and that any number of antenna elements may be used.

Similarly, reference is sometimes made herein to panel or tile sub-arrays having a particular geometric shape (e.g. square, rectangular, round) and/or size (e.g., a particular number of antenna elements) or a particular lattice type or spacing of antenna elements. One of ordinary skill in the art will appreciate that the patch radiator and techniques related thereto as described herein are applicable to various sizes and shapes of array antennas as well as to various sizes and shapes of panels (or tiles) and/or panel sub-arrays (or tile sub-arrays).

Those of ordinary skill in the art, after reading the description provided herein, will appreciate that the size of one or more antenna elements may be selected for operation at any frequency in the RF frequency range (e.g. any frequency in the range of about 400 MHz GHz to about 100 GHz).

It should also be appreciated that the antenna elements in each panel or tile sub-array can be provided having any one of a plurality of different antenna element lattice arrangements including periodic lattice arrangements (or configurations) such as rectangular, square, triangular (e.g. equilateral or isosceles triangular), and spiral configurations as well as non-periodic or arbitrary lattice arrangements.

Applications of at least some embodiments of the patch radiator panel array (a/k/a tile array) architectures described herein include, but are not limited to, radar, electronic warfare (EW) and communication systems for a wide variety of applications including ship based, ground based, airborne, missile and satellite applications.

As will also be explained further herein, at least some embodiments of the invention are applicable, but not limited to, military, airborne, ship borne, ground based, communications, unmanned aerial vehicles (UAV) and/or commercial wireless applications.

Figure 5:
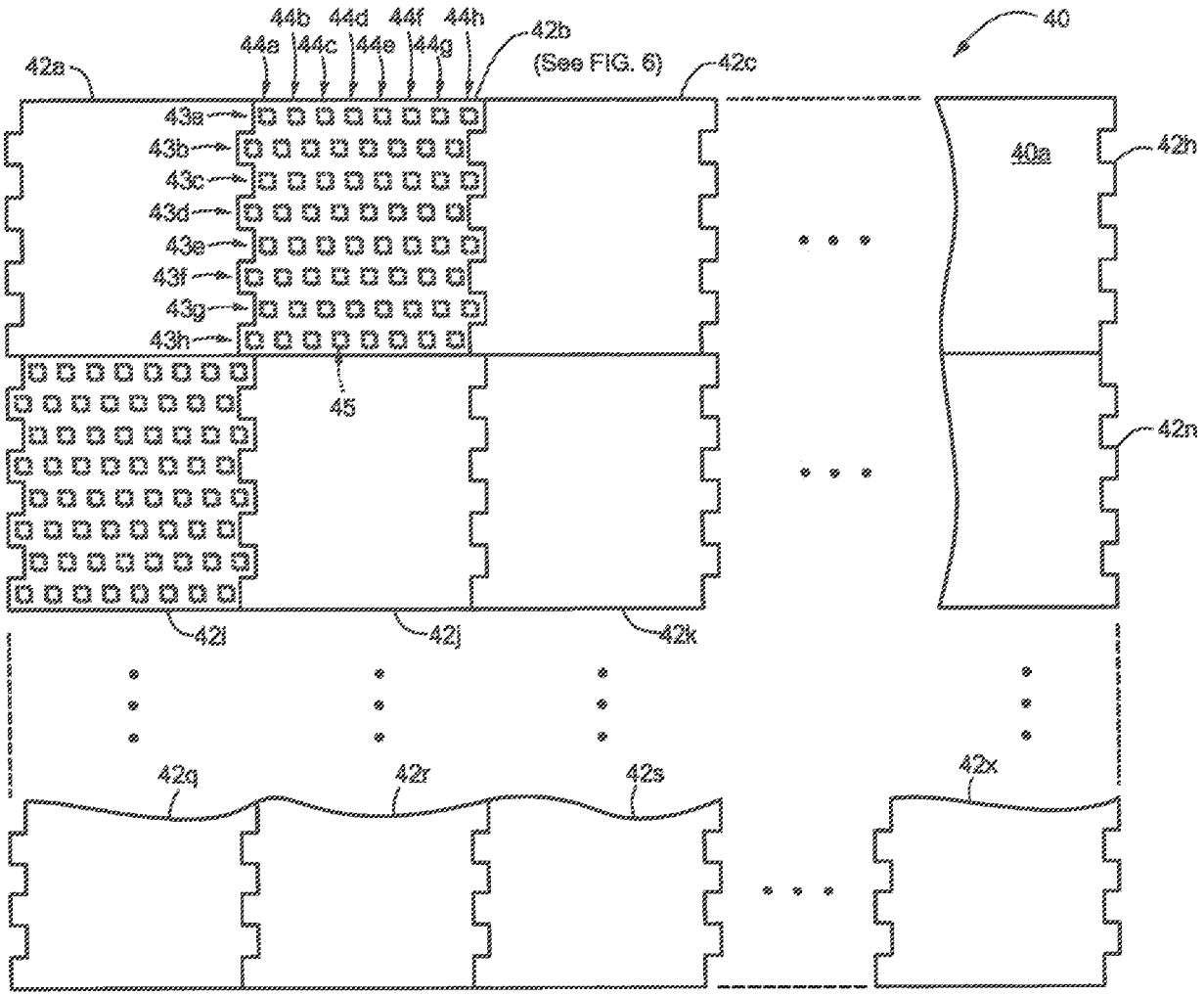
FIG. 5 is a plan view of an panel array antenna utilizing a patch radiator which may be the same as or similar to the patch radiator of FIG. 3.
Figure 6:
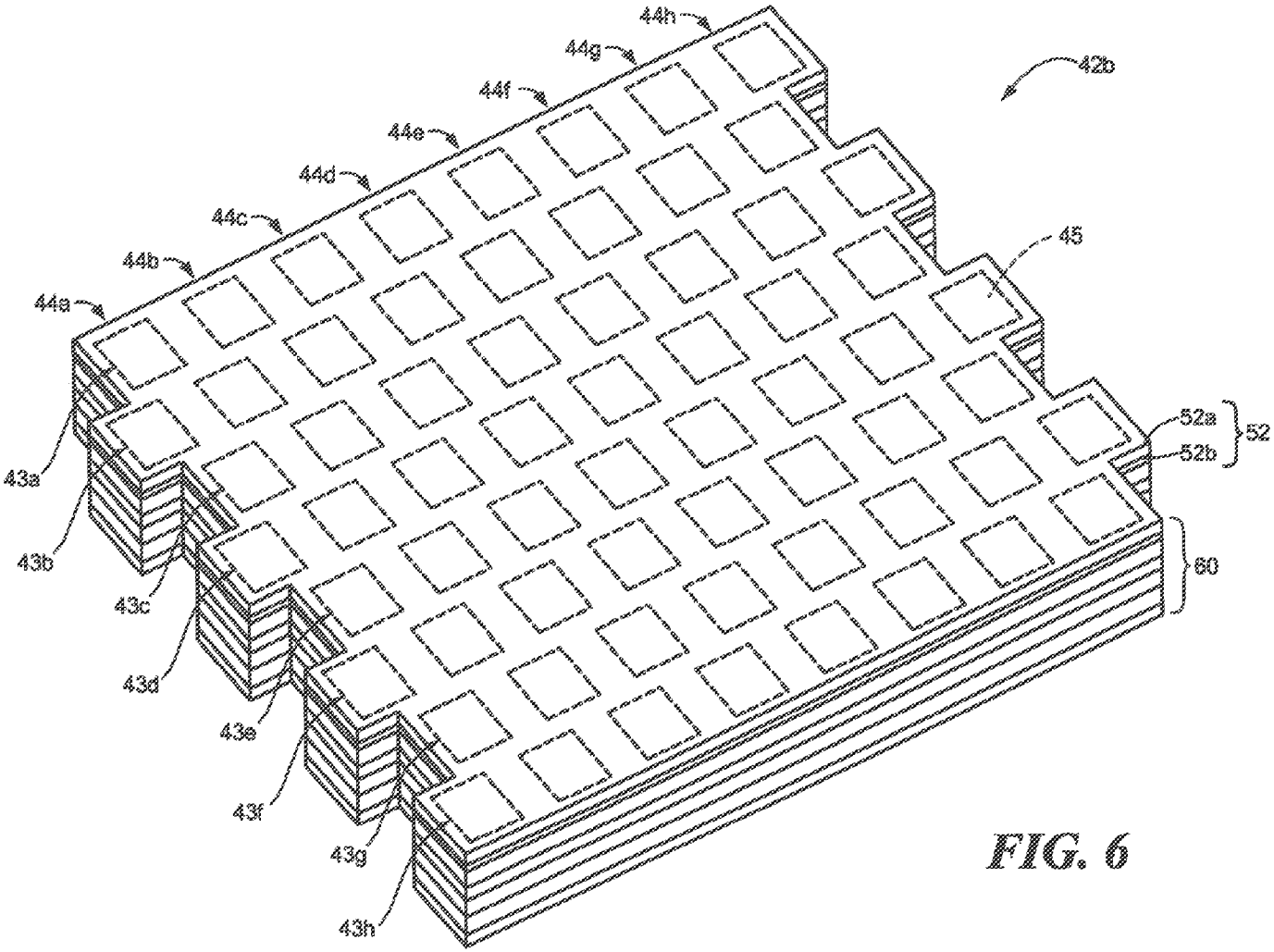
FIG. 6 is a perspective view of a panel sub-array of the type used in panel array antenna shown in FIG. 5.

It should be appreciated that in both FIGS. 5 and 6 the successive rows are staggered. There is also the case where the successive rows are aligned. Also, in the general case (rather than the specific exemplary embodiment shown in FIGS. 5 and 6) the pitch in the x any directions may not be the same.

Tuning now to FIG. 5, an array antenna 40 is comprised of a plurality of tile sub-arrays 42*a*-42*x*. It should be appreciated that in this exemplary embodiment, x total tile sub-arrays 42 comprise the entire array antenna 40. In one embodiment, the total number of tile sub-arrays is sixteen tile sub-arrays (i.e.

x=16). The particular number of tile sub-arrays 42 used to provide a complete array antenna can be selected in accordance with a variety of factors including, but not limited to, the frequency of operation, array gain, the space available for the array antenna and the particular application for which the array antenna 40 is intended to be used. Those of ordinary skill in the art will appreciate how to select the number of tile sub-arrays 42 to use in providing a complete array antenna.

As illustrated in tiles 42*b* and 42*i*, in the exemplary embodiment of FIG. 5, each tile sub-array 42*a*-42*x* comprises eight rows 43*a*-43*h* of antenna elements 45 with each row containing eight antenna elements 45 (or more simply, "elements 45"). Each of the tile sub-arrays 42*a*-42*x* is thus said to be an eight by eight (or 8×8) tile sub-array. It should be noted that each antenna element 45 is shown in phantom in FIG. 5 since the elements 45 are not directly visible on the exposed surface (or front face) of the array antenna 40. Each element 45 may be the same as or similar to patch radiator 10 described above in conjunction with FIGS. 3 and 3A. In this particular exemplary embodiment, each tile sub-array 42*a*-42*x* comprises sixty-four (64) antenna elements. In the case where the array 40 is comprised of sixteen (16) such tiles, the array 40 comprises a total of one-thousand and twenty-four (1,024) antenna elements 45.

In another embodiment, each of the tile sub-arrays 42*a*-42*x* comprise 16 elements. Thus, in the case where the array 40 is comprised of sixteen (16) such tiles and each tiles comprises sixteen (16) elements 45, the array 40 comprises a total of two-hundred and fifty-six (256) antenna elements 45.

In still another exemplary embodiment, each of the tile sub-arrays 42*a*-42*x* comprises one-thousand and twenty-four (1024) elements 45. Thus, in the case where the array 14 is comprised of sixteen (16) such tiles, the array 40 comprises a total of sixteen thousand three-hundred and eighty-four (16, 384) antenna elements 45.

In view of the above exemplary embodiments, it should thus be appreciated that each of the tile sub-arrays can include any desired number of elements. The particular number of elements to include in each of tile sub-arrays 42*a*-42*x* can be selected in accordance with a variety of factors including but not limited to the desired frequency of operation, array gain, the space available for the antenna and the particular application for which the array antenna 40 is intended to be used and the size of each sub-array 42. For any given application, those of ordinary skill in the art will appreciate how to select an appropriate number of radiating elements to include in each tile sub-array. The total number of antenna elements 45 included in a panel antenna array such as antenna array 40 depends upon the number of subarrays included in the antenna array and as well as the number of antenna elements included in each subarray.

As will become apparent from the description hereinbelow, each sub-array is electrically autonomous (excepting of course any mutual coupling which occurs between elements 45 within a tile and on different tiles). Thus, the RF feed circuitry which couples RF energy to and from each radiator on a tile is incorporated entirely within that tile (i.e. all of the RF feed and beamforming circuitry which couples RF signals to and from elements 45 in tile 42*b* are contained within tile 42*b*). Each tile includes one or more RF connectors and the RF signals are provided to the tile through the RF connector(s) provided on each tile sub-array.

Also, signal paths for logic signals and signal paths for power signals which couple signals to and from transmit/receive (T/R) circuits are contained within the tile in which the T/R circuits exist.

The RF beam for the entire array 40 is formed by an external beamformer (i.e. external to each of the subarrays 42) that combines the RF outputs from each of the tile sub-arrays 42*a*-42*x*. As is known to those of ordinary skill in the art, the beamformer may be conventionally implemented as a printed wiring board stripline circuit that combines N sub-arrays into one RF signal port (and hence the beamformer may be referred to as a 1:N beamformer).

The sub-arrays may be mechanically fastened or otherwise secured to a mounting structure using conventional techniques such that the array lattice pattern is continuous across each tile which comprises the array antenna. In one embodiment, the mounting structure may be provided as a "picture frame" to which the tile-subarrays are secured using fasteners (such as #10-32 size screws, for example). The tolerance between interlocking sections of the tile is preferably in the range of about +/−0.005 in for 10 GHz operation although larger tolerances may also be acceptable and smaller tolerances may be required based upon a variety of factors including but not limited to the frequency of operation. Preferably, the arrays 42*a*-42*x* are mechanically mounted such that the array lattice pattern (which is shown as a triangular lattice pattern in exemplary embodiment of FIG. 4) appears electrically continuous across the entire surface 40*a* (or "face") of the panel array 40.

Advantageously, the sub-array embodiments described herein can be manufactured using standard printed wiring board (PWB) manufacturing processes to produce highly integrated, passive RF circuits, using commercial, off-the-shelf (COTS) microwave materials, and highly integrated, active monolithic microwave integrated circuits (MMIC's). This results in reduced manufacturing costs. Array antenna manufacturing costs can also be reduced since the tile sub-arrays can be provided from relatively large panels or sheets of PWBs using conventional PWB manufacturing techniques.

In one exemplary embodiment, a panel array having dimensions of 0.5 meter×0.5 meter and comprising 1024 dual circular polarized antenna elements was manufactured on one sheet (or one multilayer PWB). The techniques described herein allow standard printed wiring board processes to be used to fabricate panels having dimensions up to and including 1 m×1 m with up to 4096 antenna elements from one sheet of multi-layer printed wiring boards (PWBs). Fabrication of array antennas utilizing large panels reduces cost by integrating many antenna elements with the associated RF feed and beamforming circuitry since a "batch processing" approach can be used throughout the manufacturing process including fabrication of T/R channels in the array. Batch processing refers to the use of large volume fabrication and/or assembly of materials and components using automated equipment. The ability to use a batch processing approach for fabrication of a particular antenna design is desirable since it generally results in relatively low fabrication costs. Use of the tile architecture results in an array antenna having a reduced profile and weight compared with prior art arrays of the same size (i.e. having substantially the same physical dimensions).

Figure 4A:
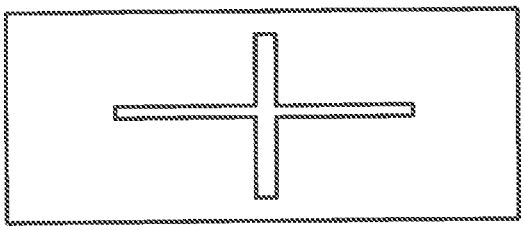
FIGS. 4A, 4B, 4C are a series of top views of various types of patch antenna element topologies suitable for use as a patch radiator of the type described above in conjunction with FIG. 3.
Figure 4B:
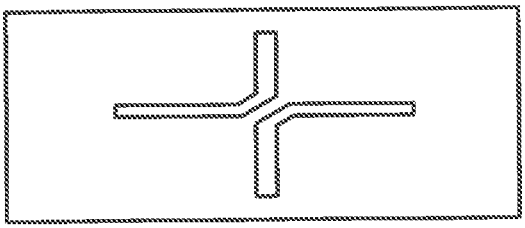
Figure 4C:
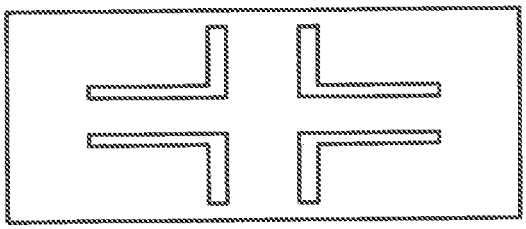

Referring now to FIG. 6 in which like elements of FIG. 4 are provided having like reference designations, and taking tile sub-array 42*b* as representative of tile sub-arrays 42*a* and 42*c*-42*x*, the tile sub-array 42*b* includes a radiator subassembly 52 which, in this exemplary embodiment, is provided as a so-called "dual circular polarized patch radiator.

The radiator subassembly 52 is provided having a first surface 52*a* which can act as a radome and having a second opposing surface 52*b*. The radiator assembly 22 is comprised of a plurality of microwave circuit boards (also referred to as PWBs) (not visible in FIG. 5). Radiator elements 45 are shown in phantom in FIGS. 5 and 6 since they are disposed below the surface 52*a* and thus are not directly visible in the view of FIG. 5.

The radiator subassembly 52 may be disposed over a plurality of other PWBs.

While particular embodiments of the present invention have been shown and described, it will be apparent to those skilled in the art that various changes and modifications in form and details may be made therein without departing from the spirit and scope of the concepts as defined by the following claims. For example, although the description provided herein above describes the concepts in the context of an array antenna having a substantially square or rectangular shape and comprised of a plurality of tile sub-arrays having a substantially square or rectangular-shape, those of ordinary skill in the art will appreciate that the concepts equally apply to other sizes and shapes of array antennas and panels (or tile sub-arrays) having a variety of different sizes and shapes. Also, the panels (or tiles) may be arranged in a variety of different lattice arrangements including, but not limited to, periodic lattice arrangements or configurations (e.g. rectangular, circular, equilateral or isosceles triangular and spiral configurations) as well as non-periodic or other geometric arrangements including arbitrarily shaped array geometries. Accordingly, the appended claims encompass within their scope all such changes and modifications.

We claim:

1. A dual linear or circularly polarized patch radiator comprising:

a patch substrate having first and second opposing surfaces;

an antenna conductor disposed over the first surface of said patch substrate to form a patch element;

a slot substrate having a first surface disposed over the second surface of said patch substrate and having a second opposing surface;

a plurality of slots in the first surface of said slot substrate, each of the slots having a centerline which is orthogonal to a centerline of at least one other slot and wherein first and second slots are disposed in a first direction with respect to the patch element and third and fourth slots are disposed in a second, orthogonal direction with respect to the patch element;

a tuning substrate having a first surface disposed over the second surface of said slot substrate and having a second opposing surface;

a pair of excitation circuits disposed over the first surface of said tuning substrate with one side of each excitation circuit grounded at an appropriate position to provide substantially pure linear excitation and the other side used as to transmit or receive from the patch antenna element wherein each excitation circuit comprises:

a feed line electrically coupled to said patch element with at least a portion of said feed line crossing one of the slots in said slot substrate and terminating in a stub region having an open circuit impedance characteristic; and a tuning circuit disposed a selected distance from the open circuit stub region of said feed line with at least a portion of said tuning circuit crossing an orthogonal one of the slots, said tuning circuit selected to provide an impedance characteristic which establishes resonance with said feed line at a desired frequency.

2. The patch radiator of claim 1 wherein said excitation circuit feed lines are coupled to adjacent sides of said antenna conductor.

3. The patch radiator of claim 1 wherein said tuning circuit is provided as a tuning stub having a shape selected to provide an impedance characteristic which establishes resonance with said feed line at a desired frequency.

4. The patch radiator of claim 3 wherein at least a portion of said tuning stub crosses one of the slots.

5. The patch radiator of claim 3 wherein said feed lines are provided from a conductor having an L-shape and said tuning stubs are provided a conductor having an L-shape.

6. The patch radiator of claim 3 wherein said antenna conductor is provided having a shape corresponding to one of:

a rectangular shape;

a triangular shape;

a semi-circular shape;

a square shape; and a semi-oval shape.

7. A patch radiator comprising:

a patch antenna element providing from a patch substrate having first and second opposing surfaces and an antenna conductor disposed over the first surface of said patch substrate; and a feed circuit comprising:

a slot substrate having a first surface disposed over the second surface of said patch substrate and having a second opposing surface;

a plurality of slots in the first surface of said slot substrate, each of the slots having a centerline which is orthogonal to a centerline of at least one other slot and wherein first and second slots are disposed in a first direction with respect to the patch element and third and fourth slots are disposed in a second, orthogonal direction with respect to the patch element;

a tuning substrate having a first surface disposed over the second surface of said slot substrate and having a second opposing surface;

a pair of excitation circuits disposed over the first surface of said tuning substrate with one side of each excitation circuit grounded at an appropriate position to provide substantially pure linear excitation and the other side used as to transmit or receive from the patch antenna element and wherein each excitation circuit comprises; a feed line terminating in a stub region having an open circuit impedance characteristic with at least a portion of said feed line crossing one of the slots in said slot substrate; and a tuning circuit disposed a selected distance from the open circuit stub region of said feed line with at least a portion of said tuning circuit crossing one of the slots in said slot substrate and wherein said tuning circuit is provided having an impedance characteristic which establishes resonance with said feed line at a desired frequency.

8. The patch radiator of claim 7 wherein said a patch antenna element comprises:

a substrate having first and second opposing surfaces;

an antenna conductor disposed on a first one of the first and second opposing surfaces of said substrate with first and second slots disposed in a first direction in said antenna conductor and third and fourth slots disposed in a second, orthogonal direction in said antenna conductor.

9. The patch radiator of claim 8 wherein said tuning circuit is provided as a tuning stub.

10. A phased array antenna comprising:

a plurality of patch radiators, each of said patch radiators comprising:

a patch antenna element provided from a patch substrate having first and second opposing surfaces and an antenna conductor disposed over the first surface of said patch substrate; and a feed circuit comprising:

a slot substrate having a first surface disposed over the second surface of said patch substrate and having a second opposing surface;

a plurality of slots in the first surface of said slot substrate, each of the slots having a centerline which is orthogonal to a centerline of at least one other slot and wherein first and second slots are disposed in a first direction with respect to the patch element and third and fourth slots are disposed in a second, orthogonal direction with respect to the patch element;

a tuning substrate having a first surface disposed over the second surface of said slot substrate and having a second opposing surface;

a pair of excitation circuits disposed over the first surface of said tuning substrate with one side of each excitation circuit grounded at an appropriate position to provide substantially pure linear excitation and the other side used as to transmit or receive from the patch antenna element and wherein each excitation circuit comprises; a feed line terminating in a stub region having an open circuit impedance characteristic with at least a portion of said feed line crossing one of the slots in said slot substrate; and a tuning circuit disposed a selected distance from the open circuit stub region of said feed line with at least a portion of said tuning circuit crossing one of the slots in said slot substrate and wherein said tuning circuit is provided having an impedance characteristic which establishes resonance with said feed line at a desired frequency.

11. The patch radiator of claim 10 wherein said tuning circuit is provided as a tuning stub having a shape selected to provide an impedance characteristic which establishes resonance with said feed line at a desired frequency.

12. The patch radiator of claim 11 wherein at least a portion of said tuning stub crosses one of the slots.

13. The patch radiator of claim 11 wherein said feed lines are provided from a conductor having an L-shape and said tuning stubs are provided a conductor having an L-shape.

14. The patch radiator of claim 11 wherein said patch antenna element is provided having a shape corresponding to one of:

a rectangular shape;

a triangular shape;

a semi-circular shape;

a square shape; and a semi-oval shape.

* * * * *